US007946054B2

(12) United States Patent
Dittmer et al.

(10) Patent No.: US 7,946,054 B2
(45) Date of Patent: May 24, 2011

(54) FRONT ASSEMBLY FOR A TUMBLE DRYER

(75) Inventors: Lothar Dittmer, Berlin (DE); Holger Löffler, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 883 days.

(21) Appl. No.: 11/886,401

(22) PCT Filed: Jan. 26, 2006

(86) PCT No.: PCT/EP2006/050457
§ 371 (c)(1),
(2), (4) Date: Sep. 13, 2007

(87) PCT Pub. No.: WO2006/097383
PCT Pub. Date: Sep. 21, 2006

(65) Prior Publication Data

US 2008/0163510 A1 Jul. 10, 2008

(30) Foreign Application Priority Data

Mar. 18, 2005 (DE) ..... 10 2005 013 048
Jan. 19, 2006 (DE) ..... 10 2006 002 713

(51) Int. Cl.
*F26B 7/00* (2006.01)

(52) U.S. Cl. ..... 34/63; 70/80; 70/90; 70/381; 70/526; 70/601; 68/19.2; 68/5 E; 219/681; 219/700; 378/173; 165/186

(58) Field of Classification Search ..... 34/63, 70, 34/80, 90, 381, 526, 601; 68/19.2, 5 E; 219/681, 219/700; 378/173; 165/186
See application file for complete search history.

(56) References Cited

U.S. PATENT DOCUMENTS 1,398,114 A * 11/1921 Prell ..... 34/63
2,225,407 A * 12/1940 Bassett, Jr. ..... 68/12.21
2,258,482 A * 10/1941 Carpenter ..... 34/526
2,283,612 A * 5/1942 Perry ..... 68/19.2
2,518,740 A * 8/1950 Albright ..... 34/466

(Continued)

FOREIGN PATENT DOCUMENTS

DE 3343833 A1 * 6/1985

(Continued)

OTHER PUBLICATIONS

International Search Report PCT/EP2006/050457.

(Continued)

*Primary Examiner* — Stephen M. Gravini
(74) *Attorney, Agent, or Firm* — James E. Howard; Andre Pallapies

(57) ABSTRACT

An assembly which is a composite including an end shield and a front wall. The size and shape of the end shield are adapted to the inner face of the front wall. Both parts are dimensioned and formed in such a way that they can be interconnected in a fixed manner to form a stable composite resembling a sandwich assembly. The joint surfaces between the front wall and the end shield lie on perpendicular planes and extend for some distance. The construction and connection of the individual parts and of the composite give the front region of the tumble dryer a high degree of rigidity, which obviates the need for additional reinforcement measures. The assembly thus saves material and mounting costs and resources.

14 Claims, 2 Drawing Sheets

U.S. PATENT DOCUMENTS

| | | | | | |
|---|---|---|---|---|---|
| 2,547,238 | A * | 4/1951 | Tremblay | 34/603 |
| 2,572,679 | A * | 10/1951 | Torres | 426/242 |
| 2,587,646 | A * | 3/1952 | O'Neil | 34/601 |
| 2,619,734 | A * | 12/1952 | Geldhof et al. | 34/546 |
| 2,643,463 | A * | 6/1953 | Grantham | 34/546 |
| 2,670,549 | A * | 3/1954 | O'Neil | 34/131 |
| 2,694,867 | A * | 11/1954 | Smith | 34/605 |
| 2,716,820 | A * | 9/1955 | Bourner | 34/82 |
| 2,722,751 | A * | 11/1955 | Steward | 34/82 |
| 2,790,247 | A * | 4/1957 | Olthuis | 34/549 |
| 2,811,539 | A * | 10/1957 | Karnofsky | 554/15 |
| 2,867,430 | A * | 1/1959 | Hullar | 432/107 |
| 2,873,539 | A * | 2/1959 | Morey | 34/597 |
| 2,886,901 | A * | 5/1959 | Whyte et al. | 34/601 |
| 2,895,230 | A * | 7/1959 | Reiley | 34/527 |
| 2,927,380 | A * | 3/1960 | Olthuis | 34/595 |
| 2,961,776 | A * | 11/1960 | Hughes | 34/607 |
| 3,039,285 | A * | 6/1962 | Smith | 68/19.2 |
| 3,059,203 | A * | 10/1962 | Hetrick | 439/27 |
| 3,064,359 | A * | 11/1962 | Geneste | 34/87 |
| 3,102,796 | A * | 9/1963 | Erickson | 34/75 |
| 3,235,082 | A * | 2/1966 | Compans | 34/319 |
| 3,555,701 | A * | 1/1971 | Hubbard | 34/602 |
| 3,584,393 | A * | 6/1971 | Menk | 34/562 |
| 3,584,394 | A * | 6/1971 | Grabek | 34/599 |
| 3,651,671 | A * | 3/1972 | Sando et al. | 68/5 E |
| 3,661,578 | A * | 5/1972 | Mason | 430/248 |
| 3,817,618 | A * | 6/1974 | Riley et al. | 355/100 |
| 3,818,603 | A * | 6/1974 | Marcade | 34/532 |
| 3,938,357 | A * | 2/1976 | Leib | 69/23 |
| 3,989,950 | A * | 11/1976 | Hunt et al. | 378/173 |
| 4,006,535 | A * | 2/1977 | Nelson | 34/572 |
| 4,031,400 | A * | 6/1977 | Hunt et al. | 378/173 |
| 4,334,136 | A * | 6/1982 | Mahan et al. | 219/681 |
| 4,356,640 | A * | 11/1982 | Jansson | 34/261 |
| 4,441,003 | A * | 4/1984 | Eves et al. | 219/700 |
| 4,510,361 | A * | 4/1985 | Mahan | 219/697 |
| 4,570,045 | A * | 2/1986 | Jeppson | 219/699 |
| 4,653,200 | A * | 3/1987 | Werner | 34/82 |
| 4,700,495 | A * | 10/1987 | Drews et al. | 34/603 |
| 4,765,066 | A * | 8/1988 | Yoon | 34/261 |
| 4,996,780 | A * | 3/1991 | Soul-Sun Goe | 34/323 |
| 5,083,870 | A * | 1/1992 | Sindelar et al. | 366/25 |
| 5,088,210 | A * | 2/1992 | Goe | 34/130 |
| 5,152,079 | A * | 10/1992 | Goe | 34/130 |
| 5,305,533 | A * | 4/1994 | Alexander et al. | 34/549 |
| 5,339,613 | A * | 8/1994 | Wymore | 56/344 |
| 5,687,965 | A * | 11/1997 | Matsuda et al. | 271/241 |
| 5,830,548 | A * | 11/1998 | Andersen et al. | 428/36.4 |
| 5,852,881 | A * | 12/1998 | Kuroda et al. | 34/527 |
| 5,947,051 | A * | 9/1999 | Geiger | 114/313 |
| 5,983,520 | A * | 11/1999 | Kim et al. | 34/261 |
| 6,036,988 | A * | 3/2000 | Lemme et al. | 426/466 |
| 6,233,841 | B1 * | 5/2001 | Beach | 34/262 |
| 6,253,530 | B1 * | 7/2001 | Price et al. | 52/793.1 |
| 6,289,650 | B1 * | 9/2001 | Usui et al. | 53/381.1 |
| 6,332,029 | B1 * | 12/2001 | Azima et al. | 381/152 |
| 6,478,461 | B1 * | 11/2002 | Frank | 366/25 |
| 6,481,035 | B2 * | 11/2002 | Seagar et al. | 8/159 |
| 6,576,390 | B1 * | 6/2003 | Shimizu et al. | 430/207 |
| 6,637,266 | B1 * | 10/2003 | Froom | 73/583 |
| 6,643,953 | B2 * | 11/2003 | Song et al. | 34/604 |
| 6,647,328 | B2 * | 11/2003 | Walker | 701/36 |
| 6,647,643 | B2 * | 11/2003 | Song et al. | 34/595 |
| 6,904,154 | B2 * | 6/2005 | Azima et al. | 381/152 |
| 6,935,048 | B2 * | 8/2005 | Park et al. | 34/132 |
| 6,968,632 | B2 * | 11/2005 | Guinibert et al. | 34/602 |
| 7,036,243 | B2 * | 5/2006 | Doh et al. | 34/595 |
| 7,065,905 | B2 * | 6/2006 | Guinibert et al. | 34/603 |
| 7,093,377 | B2 * | 8/2006 | Doh et al. | 34/596 |
| 7,117,613 | B2 * | 10/2006 | Guinibert et al. | 34/534 |
| 7,121,018 | B2 * | 10/2006 | Lee | 34/595 |
| 7,158,647 | B2 * | 1/2007 | Azima et al. | 381/152 |
| 7,159,910 | B2 * | 1/2007 | Hwang | 292/341.15 |
| 7,194,098 | B2 * | 3/2007 | Azima et al. | 381/152 |
| 7,197,838 | B2 * | 4/2007 | Jo | 34/76 |
| 7,220,365 | B2 * | 5/2007 | Qu et al. | 252/70 |
| 7,225,562 | B2 * | 6/2007 | Guinibert et al. | 34/601 |
| 7,228,647 | B2 * | 6/2007 | Hong | 34/596 |
| 7,251,905 | B2 * | 8/2007 | Doh et al. | 34/603 |
| 7,257,905 | B2 * | 8/2007 | Guinibert et al. | 34/82 |
| 7,259,357 | B2 * | 8/2007 | Walker | 219/243 |
| 7,267,150 | B2 * | 9/2007 | Shimizu et al. | 156/378 |
| 7,272,961 | B2 * | 9/2007 | Jeong | 68/19.1 |
| 7,313,874 | B2 * | 1/2008 | Park | 34/493 |
| 7,322,785 | B2 * | 1/2008 | Hall et al. | 414/291 |
| 7,340,849 | B2 * | 3/2008 | Kim | 34/602 |
| 7,347,009 | B2 * | 3/2008 | Ahn et al. | 34/607 |
| 7,360,323 | B2 * | 4/2008 | Lee et al. | 34/601 |
| 7,406,780 | B2 * | 8/2008 | Doh et al. | 34/606 |
| 7,409,841 | B2 * | 8/2008 | Oh et al. | 68/12.23 |
| 7,412,783 | B2 * | 8/2008 | Guinibert et al. | 34/572 |
| 7,418,789 | B2 * | 9/2008 | Choi et al. | 34/380 |
| 7,421,865 | B2 * | 9/2008 | Lee et al. | 68/15 |
| 7,441,422 | B2 * | 10/2008 | Choi | 68/58 |
| 7,467,483 | B2 * | 12/2008 | Guinibert et al. | 34/601 |
| 7,481,315 | B2 * | 1/2009 | Usui et al. | 206/455 |
| 7,506,458 | B2 * | 3/2009 | Lee et al. | 34/601 |
| 7,520,145 | B2 * | 4/2009 | Hong et al. | 68/12.27 |
| 7,523,564 | B2 * | 4/2009 | Doh | 34/601 |
| 7,526,877 | B2 * | 5/2009 | Kim et al. | 34/209 |
| 7,559,156 | B2 * | 7/2009 | Renzo | 34/595 |
| 7,591,082 | B2 * | 9/2009 | Lee et al. | 34/600 |
| 7,600,402 | B2 * | 10/2009 | Shin et al. | 68/5 C |
| 7,621,155 | B2 * | 11/2009 | Ahn | 68/15 |
| 7,640,678 | B2 * | 1/2010 | Lee et al. | 34/601 |
| 7,644,513 | B2 * | 1/2010 | Bae et al. | 34/445 |
| 7,644,515 | B2 * | 1/2010 | Doh | 34/603 |
| 7,655,884 | B2 * | 2/2010 | Engelhardt | 219/388 |
| 7,694,434 | B2 * | 4/2010 | Lee | 34/607 |
| 7,707,858 | B2 * | 5/2010 | Jeon et al. | 68/3 R |
| 7,707,860 | B2 * | 5/2010 | Hong et al. | 68/19 |
| 7,748,139 | B2 * | 7/2010 | Hong et al. | 34/601 |
| 7,762,007 | B2 * | 7/2010 | Guinibert et al. | 34/601 |
| 7,766,988 | B2 * | 8/2010 | Roberts | 55/385.1 |
| 7,811,041 | B2 * | 10/2010 | Hall et al. | 414/291 |
| 2001/0052220 | A1 * | 12/2001 | Usui et al. | 53/381.1 |
| 2001/0056544 | A1 * | 12/2001 | Walker | 713/200 |
| 2002/0027999 | A1 * | 3/2002 | Azima et al. | 381/431 |
| 2003/0066638 | A1 * | 4/2003 | Qu et al. | 165/186 |
| 2003/0089138 | A1 * | 5/2003 | Kawamura et al. | 68/17 R |
| 2003/0208992 | A1 * | 11/2003 | Shimizu et al. | 53/540 |
| 2004/0049324 | A1 * | 3/2004 | Walker | 701/1 |
| 2004/0123488 | A1 * | 7/2004 | Han | 34/595 |
| 2004/0134093 | A1 * | 7/2004 | Han | 34/595 |
| 2004/0221478 | A1 * | 11/2004 | Lee et al. | 34/603 |
| 2004/0221479 | A1 * | 11/2004 | Lee et al. | 34/603 |
| 2004/0261953 | A1 * | 12/2004 | Hart | 160/80 |
| 2005/0076535 | A1 * | 4/2005 | Guinibert et al. | 34/601 |
| 2005/0115104 | A1 * | 6/2005 | Guinibert et al. | 34/601 |
| 2005/0126035 | A1 * | 6/2005 | Lee et al. | 34/602 |
| 2005/0132593 | A1 * | 6/2005 | Doh et al. | 34/73 |
| 2005/0132594 | A1 * | 6/2005 | Doh et al. | 34/73 |
| 2005/0132603 | A1 * | 6/2005 | Jeong et al. | 34/603 |
| 2005/0132604 | A1 * | 6/2005 | Hong et al. | 34/603 |
| 2005/0132757 | A1 * | 6/2005 | Lee et al. | 68/15 |
| 2005/0138831 | A1 * | 6/2005 | Lee | 34/73 |
| 2005/0147273 | A1 * | 7/2005 | Azima et al. | 381/431 |
| 2005/0147274 | A1 * | 7/2005 | Azima et al. | 381/431 |
| 2005/0166421 | A1 * | 8/2005 | Doh et al. | 34/603 |
| 2005/0188471 | A1 * | 9/2005 | Ahn et al. | 8/158 |
| 2005/0229649 | A1 * | 10/2005 | Kim et al. | 68/20 |
| 2005/0229650 | A1 * | 10/2005 | Kim et al. | 68/20 |
| 2005/0281999 | A1 * | 12/2005 | Hofmann et al. | 428/304.4 |
| 2006/0005418 | A1 * | 1/2006 | Kim | 34/108 |
| 2006/0075790 | A1 * | 4/2006 | Jeon et al. | 68/17 R |
| 2006/0081014 | A1 * | 4/2006 | Choi et al. | 68/3 R |
| 2006/0086001 | A1 * | 4/2006 | Jeong et al. | 34/606 |
| 2006/0090524 | A1 * | 5/2006 | Jeon et al. | 68/135 |
| 2006/0096114 | A1 * | 5/2006 | Hong | 34/77 |
| 2006/0104759 | A1 * | 5/2006 | Hall et al. | 414/359 |
| 2006/0123853 | A1 * | 6/2006 | Hong et al. | 68/19 |
| 2006/0137205 | A1 * | 6/2006 | Lee et al. | 34/60 |
| 2006/0137206 | A1 * | 6/2006 | Lee et al. | 34/86 |
| 2006/0137208 | A1 * | 6/2006 | Lee et al. | 34/130 |
| 2006/0137210 | A1 * | 6/2006 | Lee et al. | 34/201 |
| 2006/0159293 | A1 * | 7/2006 | Azima et al. | 381/152 |

| | | | | |
|---|---|---|---|---|
| 2006/0179896 | A1* | 8/2006 | Lim et al. | 68/20 |
| 2006/0218817 | A1* | 10/2006 | Lee | 34/604 |
| 2006/0218976 | A1* | 10/2006 | Lee et al. | 68/15 |
| 2006/0230630 | A1* | 10/2006 | Lee et al. | 34/108 |
| 2006/0242856 | A1* | 11/2006 | Kim et al. | 34/202 |
| 2006/0260150 | A1* | 11/2006 | Doh | 34/601 |
| 2006/0265899 | A1* | 11/2006 | Renzo | 34/603 |
| 2006/0266506 | A1* | 11/2006 | Lee et al. | 165/166 |
| 2006/0272173 | A1* | 12/2006 | Myung | 34/469 |
| 2006/0288602 | A1* | 12/2006 | Lee et al. | 34/86 |
| 2007/0006477 | A1* | 1/2007 | Guinibert et al. | 34/85 |
| 2007/0033828 | A1* | 2/2007 | Hartkop et al. | 34/443 |
| 2007/0108177 | A1* | 5/2007 | Engelhardt | 219/388 |
| 2007/0113594 | A1* | 5/2007 | Ahn et al. | 68/3 R |
| 2007/0163056 | A1* | 7/2007 | Lee et al. | 8/149.2 |
| 2007/0172339 | A1* | 7/2007 | La Forest et al. | 414/404 |
| 2007/0186440 | A1* | 8/2007 | Guinibert et al. | 34/603 |
| 2007/0186593 | A1* | 8/2007 | Ahn | 68/5 R |
| 2007/0220776 | A1* | 9/2007 | Guinibert et al. | 34/603 |
| 2007/0227199 | A1* | 10/2007 | Kim et al. | 68/12.26 |
| 2007/0261715 | A1* | 11/2007 | Lee et al. | 134/30 |
| 2008/0053166 | A1* | 3/2008 | Lim | 68/5 C |
| 2008/0060218 | A1* | 3/2008 | Doh | 34/601 |
| 2008/0085175 | A1* | 4/2008 | Hall et al. | 414/291 |
| 2008/0091309 | A1* | 4/2008 | Walker | 701/1 |
| 2008/0104862 | A1* | 5/2008 | Dittmar et al. | 34/601 |
| 2008/0141558 | A1* | 6/2008 | Bae et al. | 34/595 |
| 2008/0148597 | A1* | 6/2008 | Kim et al. | 34/549 |
| 2008/0163510 | A1* | 7/2008 | Dittmar et al. | 34/108 |
| 2008/0168679 | A1* | 7/2008 | Son et al. | 34/497 |
| 2008/0178634 | A1* | 7/2008 | Kim et al. | 68/23.2 |
| 2008/0189974 | A1* | 8/2008 | Dittmer et al. | 34/132 |
| 2008/0201977 | A1* | 8/2008 | Song et al. | 34/73 |
| 2008/0250819 | A1* | 10/2008 | Park et al. | 68/12.05 |
| 2008/0256989 | A1* | 10/2008 | Jeong et al. | 68/5 C |
| 2008/0271263 | A1* | 11/2008 | Bae et al. | 8/159 |
| 2008/0276660 | A1* | 11/2008 | Bae et al. | 68/5 C |
| 2008/0276661 | A1* | 11/2008 | Bae et al. | 68/5 C |
| 2008/0282569 | A1* | 11/2008 | Roberts | 34/82 |
| 2008/0282745 | A1* | 11/2008 | Han et al. | 68/20 |
| 2008/0282751 | A1* | 11/2008 | Yoon et al. | 68/5 C |
| 2009/0071030 | A1* | 3/2009 | Myung et al. | 34/138 |
| 2009/0083992 | A1* | 4/2009 | Prajescu et al. | 34/601 |
| 2009/0120140 | A1* | 5/2009 | Choi et al. | 68/5 C |
| 2009/0126222 | A1* | 5/2009 | Bae et al. | 34/527 |
| 2009/0133281 | A1* | 5/2009 | Yoon et al. | 34/72 |
| 2009/0145176 | A1* | 6/2009 | Kim et al. | 68/27 |
| 2009/0145177 | A1* | 6/2009 | Kim et al. | 68/13 R |
| 2009/0146536 | A1* | 6/2009 | Kim et al. | 312/228 |
| 2009/0223082 | A1* | 9/2009 | Baek et al. | 34/497 |
| 2009/0265953 | A1* | 10/2009 | Bae et al. | 34/467 |
| 2009/0277036 | A1* | 11/2009 | Lee et al. | 34/215 |
| 2010/0000117 | A1* | 1/2010 | Choi et al. | 34/443 |
| 2010/0058610 | A1* | 3/2010 | Kim et al. | 34/474 |
| 2010/0077801 | A1* | 4/2010 | Son et al. | 68/20 |
| 2010/0083521 | A1* | 4/2010 | Han et al. | 34/130 |
| 2010/0083709 | A1* | 4/2010 | Han et al. | 68/13 R |
| 2010/0083710 | A1* | 4/2010 | Han et al. | 68/13 R |
| 2010/0083711 | A1* | 4/2010 | Han et al. | 68/13 R |
| 2010/0095548 | A1* | 4/2010 | Kim et al. | 34/73 |
| 2010/0115784 | A1* | 5/2010 | Jo et al. | 34/132 |
| 2010/0115785 | A1* | 5/2010 | Ben-Shmuel et al. | 34/260 |
| 2010/0146809 | A1* | 6/2010 | Grunert et al. | 34/443 |
| 2010/0150359 | A1* | 6/2010 | KnicKrehm et al. | 381/58 |
| 2010/0162586 | A1* | 7/2010 | Lee | 34/130 |
| 2010/0165276 | A1* | 7/2010 | David et al. | 349/122 |
| 2010/0210745 | A1* | 8/2010 | McDaniel et al. | 521/55 |
| 2010/0227963 | A1* | 9/2010 | Hironaka et al. | 524/451 |
| 2010/0229852 | A1* | 9/2010 | Buckley | 126/652 |
| 2010/0260584 | A1* | 10/2010 | Hall et al. | 414/291 |
| 2010/0263709 | A1* | 10/2010 | Norman et al. | 136/246 |
| 2011/0000100 | A1* | 1/2011 | Malcher et al. | 34/499 |

FOREIGN PATENT DOCUMENTS

| | | | | |
|---|---|---|---|---|
| DE | 3546434 | A1 | * | 9/1986 |
| DE | 4344032 | A1 | * | 6/1995 |
| DE | 44 22 000 | | | 1/1996 |
| DE | 19504672 | C1 | * | 6/1996 |
| DE | 19709931 | A1 | * | 11/1997 |
| DE | 198 11 962 | | | 9/1999 |
| DE | 19819421 | A1 | * | 11/1999 |
| DE | 19920009 | A1 | * | 11/2000 |
| DE | 102006054829 | A1 | * | 5/2007 |
| EP | 108976 | A2 | * | 5/1984 |
| EP | 136491 | A2 | * | 4/1985 |
| EP | 0 183 176 | | | 6/1986 |
| EP | 219422 | A1 | * | 4/1987 |
| EP | 330822 | A2 | * | 9/1989 |
| EP | 387942 | A1 | * | 9/1990 |
| EP | 405869 | A2 | * | 1/1991 |
| EP | 436375 | A2 | * | 7/1991 |
| EP | 499123 | A2 | * | 8/1992 |
| EP | 556907 | A1 | * | 8/1993 |
| EP | 561652 | A1 | * | 9/1993 |
| EP | 621364 | A1 | * | 10/1994 |
| EP | 651123 | A1 | * | 5/1995 |
| EP | 725201 | A1 | * | 8/1996 |
| EP | 796652 | A1 | * | 9/1997 |
| EP | 981195 | A2 | * | 2/2000 |
| EP | 1584735 | A2 | * | 10/2005 |
| EP | 1 598 473 | | | 11/2005 |
| EP | 1690973 | A1 | * | 8/2006 |
| EP | 1857585 | A1 | * | 11/2007 |
| FR | 2642466 | A1 | * | 8/1990 |
| FR | 2673234 | A1 | * | 8/1992 |
| FR | 2778678 | A1 | * | 11/1999 |
| FR | 2802237 | A1 | * | 6/2001 |
| GB | 2071203 | A | * | 9/1981 |
| GB | 2 114 723 | | | 8/1983 |
| GB | 2271383 | A | * | 4/1994 |
| JP | 54098062 | A | * | 8/1979 |
| JP | 54102659 | A | * | 8/1979 |
| JP | 57078557 | A | * | 5/1982 |
| JP | 60050685 | A | * | 3/1985 |
| JP | 60092925 | A | * | 5/1985 |
| JP | 61064601 | A | * | 4/1986 |
| JP | 03297496 | A | * | 12/1991 |
| JP | 10235086 | A | * | 9/1998 |
| WO | WO 8908946 | A1 | * | 9/1989 |
| WO | WO 9316262 | A1 | * | 8/1993 |
| WO | WO 9638644 | A1 | * | 12/1996 |
| WO | WO 2004085781 | A2 | * | 10/2004 |

OTHER PUBLICATIONS

National Search Report DE 10 2005 013 048.8.

* cited by examiner

FRONT ASSEMBLY FOR A TUMBLE DRYER

BACKGROUND OF THE INVENTION

The invention is based on a front assembly for a tumble dryer, especially for a condensation dryer, with an electrically driven drum for accommodating items to be dried which is able to be rotated around at least approximately horizontal axis, with an end plate shield for supporting the drum on the front side, with a floor-side base module to accommodate a drive motor and functional parts for conveying and guiding airflows and with a machine front wall with loading opening for loading items to be dried into the drum and for removing them from it.

With known tumble dryers carrier assemblies regularly consist of a stable self-supporting outer frame into which the functional components are built and secured by means of additional rails. The machine housing is enclosed by wall panels which are screwed on. A typical example of this is described in DE 198 11 962 C2. In this the external profiles are welded together and form an inherently-stable housing frame. This features stabilizing bars in the upper area and in the lower area guide rails for accommodating a slide-in base module which forms a carrier structure for functional components needed for operation. As a special feature the guide rails for the base module features steps in an offset arrangement in the direction of insertion. In the inserted state the front side of the base module is connected via securing means to the housing.

In other tumble dryers on the market the vertical corner profiles are replaced by edge areas of external wall sections formed out into corner supports. To produce a rigid housing the wall sections are braced against each other at the top and bottom. With similar stability this type of machine housing made up only of sheet steel parts, although less material-intensive, is disadvantageously very labor-intensive.

Disadvantages of the carrier constructions described are caused by the frame constructions and/or the wall sections. On the one hand a comparatively large number of individual parts are necessary and on the other hand the assembly of the tumble dryer is complicated and installing the functional modules is rendered more difficult.

For a front assembly of a known tumble dryer described at the beginning and known from G 82 03 418 U1 the end shield for guiding and accepting the load of the drum is connected non-rotatably at the front to the machine housing and is supported by suitable retaining means against the carrier structure. The end shield is manufactured as an injection-molded part and features an outlet air channel pointing downwards, via which the process air carrying the moisture from the washing and moved by means of a blower is directed. The end shield is fixed into the opening of the front paneling and secured by means of screws. The known outlet channel is in the shape of a flattened rectangle and opens out at the bottom. The opening in the floor is provided with a flange which is encompassed by a press-fit sliding lid on its two long sides. The joint can be secured and sealed by gluing or welding. The process air is directed outwards via a connecting support pointing inwards or is directed to a condenser.

The problem with this example, as with other known embodiments, lies in sealing the jointed parts of the end shield as well as the connection to the process air channel in the floor area so that the energy losses and the escape of moisture to the outside can be avoided. Another disadvantage of the known embodiments is the fact that the end shield is restricted to functioning as a support for the drum and for discharging air into the floor area. Additional means are required for positioning and support of the end shield, requiring a large number of individual mounting parts, which means that major effort is required for installation.

SUMMARY OF THE INVENTION

The object of the invention is to design the front area of the tumble dryer mentioned at the start in such a way as to reduce the use of materials and the installation effort compared to known devices. The inventive solution it should also have fewer leakage points and make possible a better connection between the front area and the base module.

In accordance with the invention this object is achieved on a front assembly described above by the features in the described embodiments. Inventively the end shield is adapted in relation to its size and shape to the inner surface of the front wall and the end shield and the front wall are permanently connected to each other so that they form a composite resembling a sandwich assembly. The two parts are dimensioned so that, after being joined and permanently connected to each other, they form a stable composite. Compared to known embodiments the inventive end shield has larger dimensions. The functionality as a component for accommodating and supporting the drum as well as guide channel for the process air is extended to a stability function by this embodiment and connection to the front wall. The end shield is not supported or held by profiles and rails, but in conjunction with the front wall is part of the carrier assembly stabilizing the overall tumble dryer.

In an embodiment of the invention the end shield features a joint surface to the base module which, lying in a horizontal plane, extends across the entire width of the tumble dryer. The perpendicular orientation and the size of the joint surfaces make possible a mechanically rigid and very secure connection. Clipping and/or screwing or welding the front-side composite to the base module gives the tumble dryer a high rigidity in the front and base region such that further means for reinforcement are not necessary. Even without the profiles and support rails normally used in known tumble dryers, the inventive composite comprising front wall and end shield has a sufficiently high stability to enable the front module to withstand all forces acting on it during operation and transport of the tumble dryer without sustaining damage.

By contrast with the known embodiments, the inventive construction for the front module and the mechanically-stable connection to the base module is able to be implemented using small amounts of material, with the device being lighter than a known tumble dryers despite its stable construction.

Significant advantages are also obtained from the invention in the assembly of the tumble dryer. Front wall and end shield can be equipped and connected in pre-assembly with the functional units needed for operation, control and communication from and to users. Since inventively no additional retaining parts are used for the front module and for its connection to the base module, the number of overall individual parts to be employed and to be fitted in final assembly is reduced. Dispensing with retaining means has an additional advantageous effect on the subsequent assembly operations which are not to adversely affected by braces and retaining rails. Production of the tumble dryer is more rational overall.

In addition the sealing of the air channels is improved because the inventive construction makes do with fewer individual parts needing to be connected to each other.

BRIEF DESCRIPTION OF THE DRAWINGS

The invention, further embodiments and their advantageous effects are explained in greater detail in an exemplary embodiment shown in the drawing. The drawings show FIG. 1 a schematic side view of a tumble dryer without the outer housing cover and FIG. 2 the modular construction of the tumble dryer with reference to an exploded perspective diagram.

DETAILED DESCRIPTION OF THE INVENTION

Figure 1:
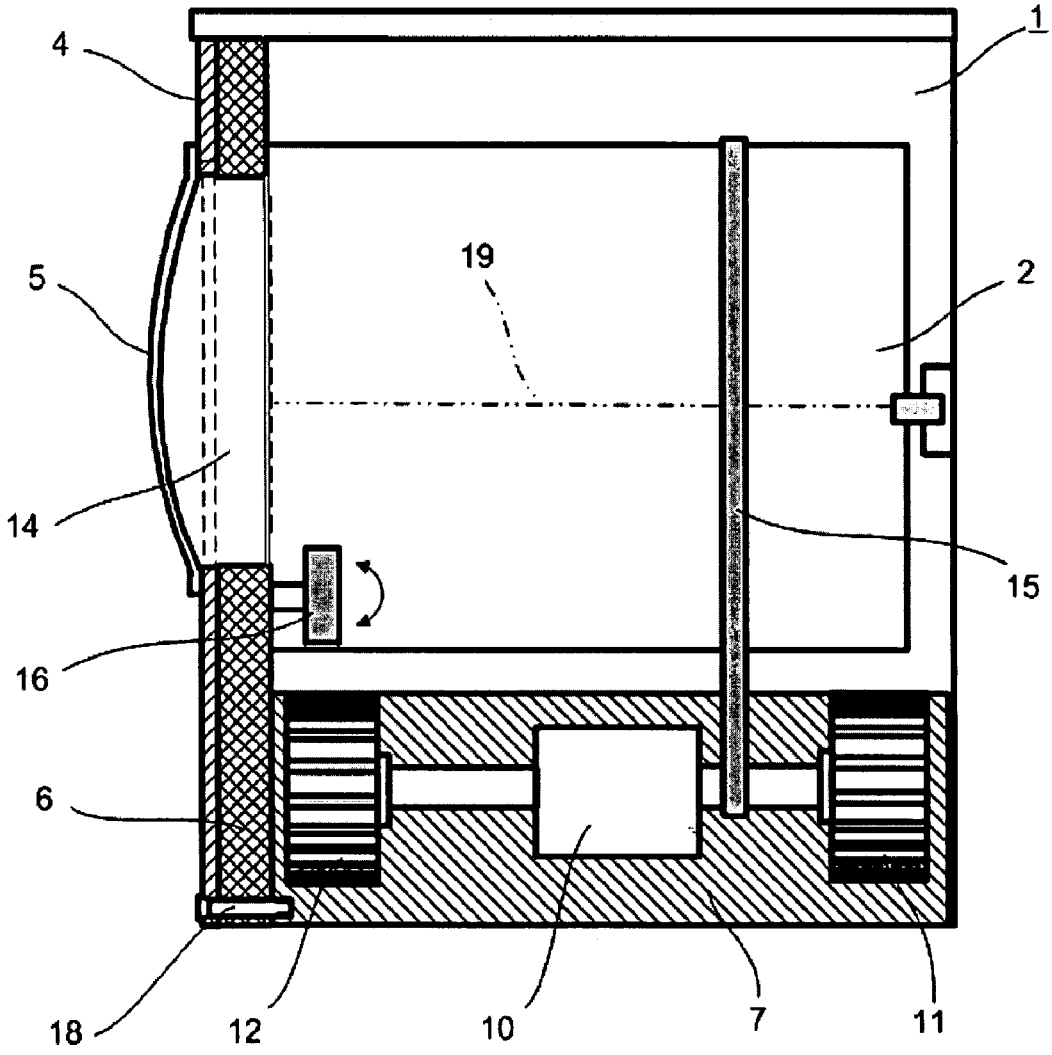
Figure 2:
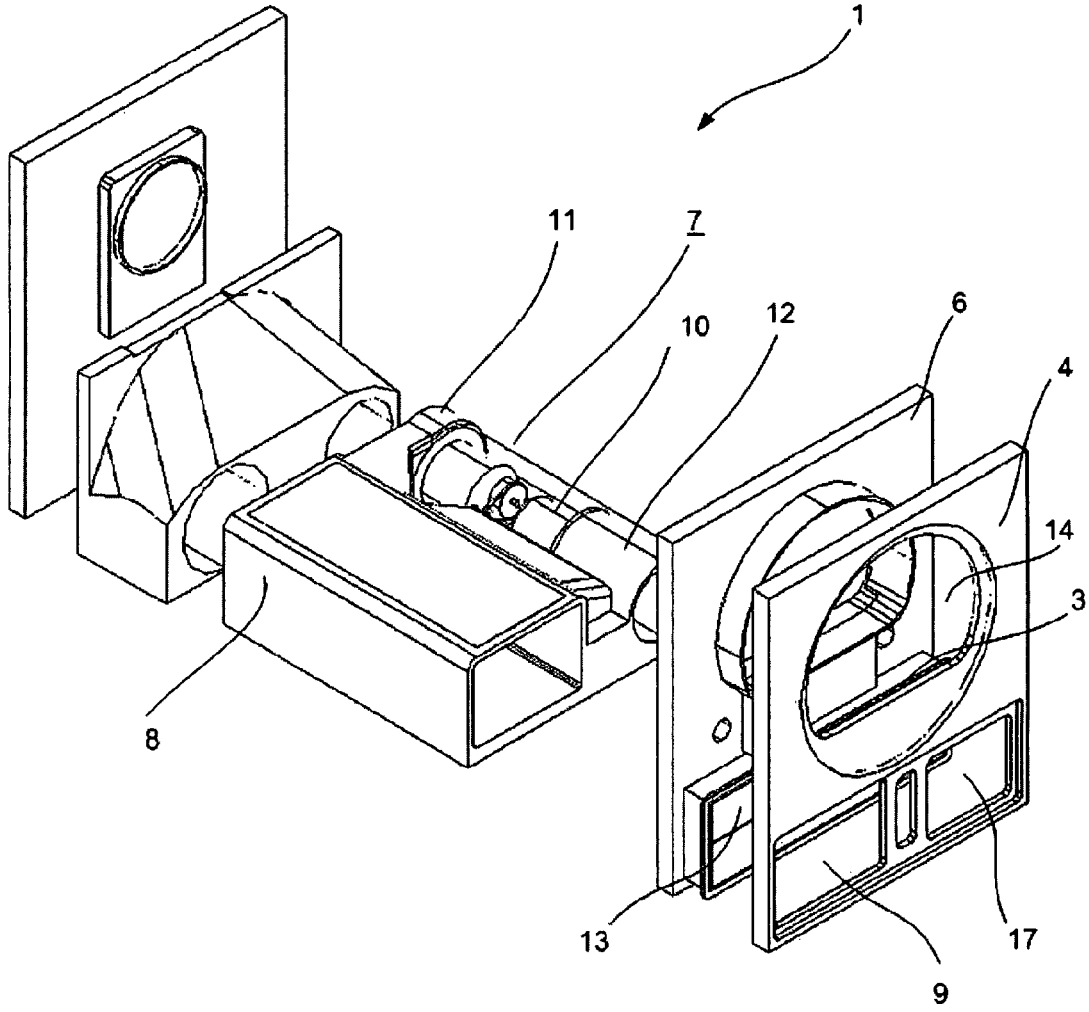

The tumble dryer 1 is depicted in two different views with the major components which, as pre-assembled units, are joined together in final assembly. In particular the not-to-scale sizes of the units in relation to each other as well as the size and arrangement of the joint surfaces of the units can be seen from the diagram. The rear part of the tumble dryer visible in FIG. 2 is not discussed in any greater detail here.

The front-side outer housing wall 4 and the end shield 6 have two openings which correspond to each other in the lower area, a cooling air inlet opening 17 and an opening for inserting the slide-in condenser. Above these is located the loading opening 14 which is able to be closed and sealed by a door 5. The shape and size of the end shield 6 is adapted to the front wall 4. The end shield 6 extends down to the floor and across the entire width of the tumble dryer 1. Front wall 4 and end shield 6 are rigidly joined to each other and screwed, and in this way form a stable composite. The end shield 6 is a one-piece plastic injection-molded part and the front wall 4 is a sheet-steel part which is only bent around once at the edges. These bent edge areas serve as mating and screw surfaces. The edge-side contact surfaces of front wall 4 and end shield 6 are formed into a slight wedge shape on their outer edges and in the region of the loading opening, so that the two parts position themselves when joined. In addition to or instead of the shaping mentioned above, other means can also be used for self-positioning of end shield 6 and front wall 4, such as beads and projections which engage with each other.

The drum 2, with its horizontal axis of rotation 19, is supported on two guide rollers 16 which, in relation to the center, are fastened offset to the side to the end shield 6. A part 13 of the process air guidance channel of via which the drying air is directed out of the drum 2 downwards into the condenser housing 8 is formed into the lower area of the end shield 6. In the inlet opening of the process air channel 13 formed by the end shield 6—as can be seen from FIG. 2—there is a lint filter, which is fitted flush into the surround of the inlet opening. For maintenance the lint filter 3 can be easily removed for cleaning when the door 5 is open by pulling it upwards.

The connection area between a base module 7 and end shield 6 has a perpendicular joint surface covering a large area or extending across the entire width of the tumble dryer 1. The base module 7 is a compact plastic element which forms a base module of the tumble dryer 1. Formed into the base module 7 are the condenser housing 8, the drive motor 10 and the process and cooling air blower housing 11, 12. Other facilities formed into the base module 7 for catching and conveying the condensate as well as for guiding the process air and the cooling air are not shown in the diagram to improve the clarity of the drawing.

Clips and mating clips are formed into the back of the end shield 6 and the front of the base module 7, which are able to be bought into engagement with each other. In the assembly sequence the front-side composite, consisting of front wall 4 and end shield 6, are initially clipped to the base module and later secured by screws. The clipping and screw connection joins the composite 4, 6 and the base module 7 into an L-shaped body. This is sufficiently stable to enable all other components to be arranged on it to be safely positioned and held firmly even with additional facilities. For the operations to be performed subsequently for further assembly and completion of the tumble dryer 1 it is of advantage here for the initially only clipped together L-shaped body to remain freely accessible from above and from three sides. The handling of further components to be fitted and the manual operations to be conducted in order to fit them are not obstructed by any braces or rails which are used with known tumble dryers for reinforcement and attaching the components. The options for more rational design of the installation technology are considerably enhanced in this way.

The connection of base module 7 and composites 4, 6 is given a final and mechanically very high stability through insertion of screws which is undertaken horizontally from the front, with the relatively long screws 18 penetrating through the end shield 6 and the front wall 4 and connecting the two units to the base module 7. The insertion of the screws 18 can be undertaken at any given time within the technological time chain which in its turn offers a great deal of freedom in the design of the installation technology.

REFERENCE SYMBOLS

1 Tumble dryer
2 Drum
3 Lint filter
4 Front wall
5 Door
6 End shield
7 Base module
8 Condenser housing
9 Slide-in condenser opening
10 Motor
11 Process air blower
12 Cooling air blower
13 Process air channel
14 Loading opening
15 Drive belt
16 bearing roller
17 Cooling air inlet opening
18 Screws
19 Center axis

The invention claimed is:

1. A front assembly for a clothes dryer comprising an electrically-driven drum being rotatable about a substantially horizontal axis for accommodating items to be dried;

an end shield for front-side support of the drum;

a floor-side base module for accommodating a drive motor and functional parts for conveying and guiding air flows; and a machine front wall with loading opening for loading items to be dried into the drum and removing them from it, wherein the front side of the end shield and the inner surface of the front wall are of corresponding size and shape, and wherein the end shield and the front wall are permanently connected to each other such that they form a composite resembling a sandwich assembly.

2. The front assembly as claimed in claim 1, wherein the end shield and the front wall are screwed to each other and the screw points are distributed over all inner and outer edge areas.

3. The front assembly as claimed in claim 1, wherein the end shield is a plastic part.

4. The front assembly as claimed in claim 1, wherein the composite comprising front wall and end shield has at least one perpendicular joint surface to the base module, which extends over substantially the entire width of the tumble dryer.

5. The front assembly as claimed in claim 4, wherein the composite comprising front wall and end shield is connected to the base module such that the two parts form a stable L-shaped body.

6. The front assembly as claimed in claim 5, wherein the composite is latched to the base module.

7. The front assembly as claimed in claim 5, wherein the composite is screwed to the base module.

8. The front assembly as claimed in claim 7, wherein the screws are inserted in a horizontal direction through the front wall and the end shield to engage the base module.

9. The front assembly as claimed in claim 6, wherein the joint surface of the base module facing the composite is made of plastic and that the composite is welded to the base module.

10. The front assembly as claimed in claim 1, wherein the clothes dryer includes a condensation dryer.

11. The front assembly as claimed in claim 1, comprising means for self-positioning the end shield and the front wall.

12. A front assembly for a clothes dryer comprising:

an electrically-driven drum being rotatable about a substantially horizontal axis for accommodating items to be dried;

an end shield for front-side support of the drum;

a floor-side base module for accommodating a drive motor and functional parts for conveying and guiding air flows;

a machine front wall with loading opening for loading items to be dried into the drum and removing them from it; and a door attached to the machine front wall for sealing and closing the loading opening, wherein the front side of the end shield and the inner surface of the front wall are of corresponding size and shape, wherein contact surfaces of the front wall and the end shield are shaped to position themselves when joined, and wherein the end shield and the front wall are permanently connected to each other such that they form a composite resembling a sandwich assembly.

13. The front assembly as claimed in claim 12, wherein the edge-sides of the contact surfaces are formed into a wedge shape.

14. The front assembly as claimed in claim 12, comprising at least one of beads and projections for self-positioning of the end shield and the front wall.

* * * * *